US006401378B1

(12) United States Patent
Ockenfuss

(10) Patent No.: US 6,401,378 B1
(45) Date of Patent: Jun. 11, 2002

(54) SAFETY MECHANISM FOR A BREECHBLOCK FOR REPEATING WEAPONS

(75) Inventor: Ulrich Ockenfuss, Baiersbronn (DE)

(73) Assignee: Sommer + Ockenfuss GmbH, Baierbronn (DE)

( * ) Notice: Subject to any disclaimer, the term of this patent is extended or adjusted under 35 U.S.C. 154(b) by 0 days.

(21) Appl. No.: 09/472,679

(22) Filed: Dec. 27, 1999

(30) Foreign Application Priority Data

Dec. 3, 1999 (DE) ..... 199 58 337

(51) Int. Cl.[7] ..... F41A 17/00
(52) U.S. Cl. ..... 42/70.01; 42/69.02
(58) Field of Search ..... 42/70.01, 16, 69.02; 89/1, 42

(56) References Cited

U.S. PATENT DOCUMENTS 1,294,452 A * 2/1919 Hammond ..... 42/16
2,069,887 A * 2/1937 Laundensack ..... 42/69
3,106,033 A * 10/1963 Brewer ..... 42/69
3,330,061 A * 7/1967 Koon ..... 42/16
3,631,620 A * 1/1972 Ohira ..... 42/16
4,445,292 A * 5/1984 Martin ..... 42/16
4,547,988 A * 10/1985 Nilsson ..... 42/16
4,569,145 A * 2/1986 Ruger et al. ..... 42/16
5,722,194 A * 3/1998 Wurger et al. ..... 42/69.02

FOREIGN PATENT DOCUMENTS

AT 1.141584 4/1935

* cited by examiner

*Primary Examiner*—Peter M. Poon
*Assistant Examiner*—M Thomson
(74) *Attorney, Agent, or Firm*—Darby & Darby

(57) ABSTRACT

A safety mechanism for a breechblock (10) for repeating weapons, having an operating means (29) arranged on the bolt handle (19), the operating means are operatively connected to a locking bolt (33) which, in the securing position and the safety-release position of the breechblock (10), can be brought into engagement with associated locking grooves (37, 38) of the breechblock sleeve (11).

3 Claims, 3 Drawing Sheets

SAFETY MECHANISM FOR A BREECHBLOCK FOR REPEATING WEAPONS

BACKGROUND OF THE INVENTION

1. Field of the Invention

The invention relates to a safety mechanism for a breechblock, in particular a rotating boss breechblock, for repeating weapons.

The object of all known breechblock constructions is the absolutely secure locking of the breechblock portions which close the barrel of a weapon at its rear end at the instant of the shot, with simultaneously simple operation and reliable securing before the shot is fired.

2. Description of the Related Art

It is known to carry out the locking of the breechblock by means of locking bosses located on the breechblock sleeve, wherein as a result of a downwardly twisting movement of the bolt handle associated with the breechblock, the locking bosses are moved into their associated recesses in portions of the bolt sleeve. In this connection, the securing takes place, as a rule, by means of slide-type or wing-type safety mechanisms which prevent the trigger and/or the firing pin of the breechblock from moving.

By way of example, the safety mechanism in the known Mauser K 98 rifle takes place by means of a three-position wing-type safety mechanism which, in stages, secures the trigger in the first position, secures the firing pin or the cocking piece in the second position, and in the third position releases the breechblock for the shot. Such a breechblock has a breechblock sleeve which supports a bolt handle and is guided along the bolt sleeve head and bolt sleeve bridge of the repeating weapon and can be locked in the cocked state of the breechblock by way of locking bosses which engage in corresponding recesses in the above-mentioned portions of the bolt sleeve. The above-mentioned three-position wing-type safety mechanism is provided as securing means for securing and releasing the firing pin in the named position.

Experience has now shown that the actuation of such a securing wing in addition to the actuation of the bolt handle which is spatially separated therefrom is not only troublesome but also gives rise to mistakes in operation.

The underlying object of the invention is therefore to improve with simple means a safety mechanism of the type mentioned in the introduction that is suitable for repeating weapons, in order to facilitate operation and increase safety.

SUMMARY OF THE INVENTION

This object is achieved in accordance with the invention by a safety mechanism for a breechblock for repeating weapons having a breechblock sleeve which surrounds a firing pin and supports a bolt handle sleeve, is guided along a sleeve of the repeating weapon and can be locked in the cocked state of the breechblock by way of locking bosses which engage in corresponding recesses in the sleeve portions, and having securing means for securing and releasing the firing pin in the cocked position, which securing means comprise a locking bolt and a securing finger, of which the locking bolt, by way of the bolt handle and an operating knob spring-mounted on the bolt handle, can be brought into engagement with one of two locking grooves in the sleeve which is coaxial to the breechblock sleeve, which locking grooves are associated with the securing position and the safety-release position of the breechblock, while the securing finger is formed as part of the cocking piece of the breechblock and associated therewith in the safety-release position of the breechblock is a corresponding free milling on the bolt handle sleeve that allows the movement of the firing pin. According to a preferred exemplary embodiment of the invention, the locking bolt, which can be brought into engagement with the locking grooves, has a bolt head which corresponds with the locking grooves of the breechblock sleeve, which locking grooves, for the purpose of receiving the shank portion of the locking anchor, are connected to each other by way of a central recess, with the shank portion of the locking bolt being operatively connected to a bolt-shaped pin of the operating knob, which is held on the bolt handle in a manner such that it springs into the securing position. In this connection, associated with the securing finger, in the end face of the bolt handle sleeve that faces the latter, are a free milling and a catch surface, in such a way that in the securing position of the breechblock, the catch surface prevents a movement of the firing pin, while in the safety-release position on the other hand, the free milling allows a movement of the firing pin.

Preferably, the set screw, which is arranged concentrically with respect to the safety knob and screwed thereto, turns into the shank portion of the locking bolt and the safety knob is mounted in a blind bore arranged on the bolt handle foot in a manner such that it is movable against the action of a spring.

BRIEF DESCRIPTION OF THE DRAWINGS

In the following, the invention is described with the aid of an exemplary embodiment represented more or less diagrammatically in the drawing, in which.

DETAILED DESCRIPTION OF THE PRESENTLY PREFERRED EMBODIMENTS

Figure 1:
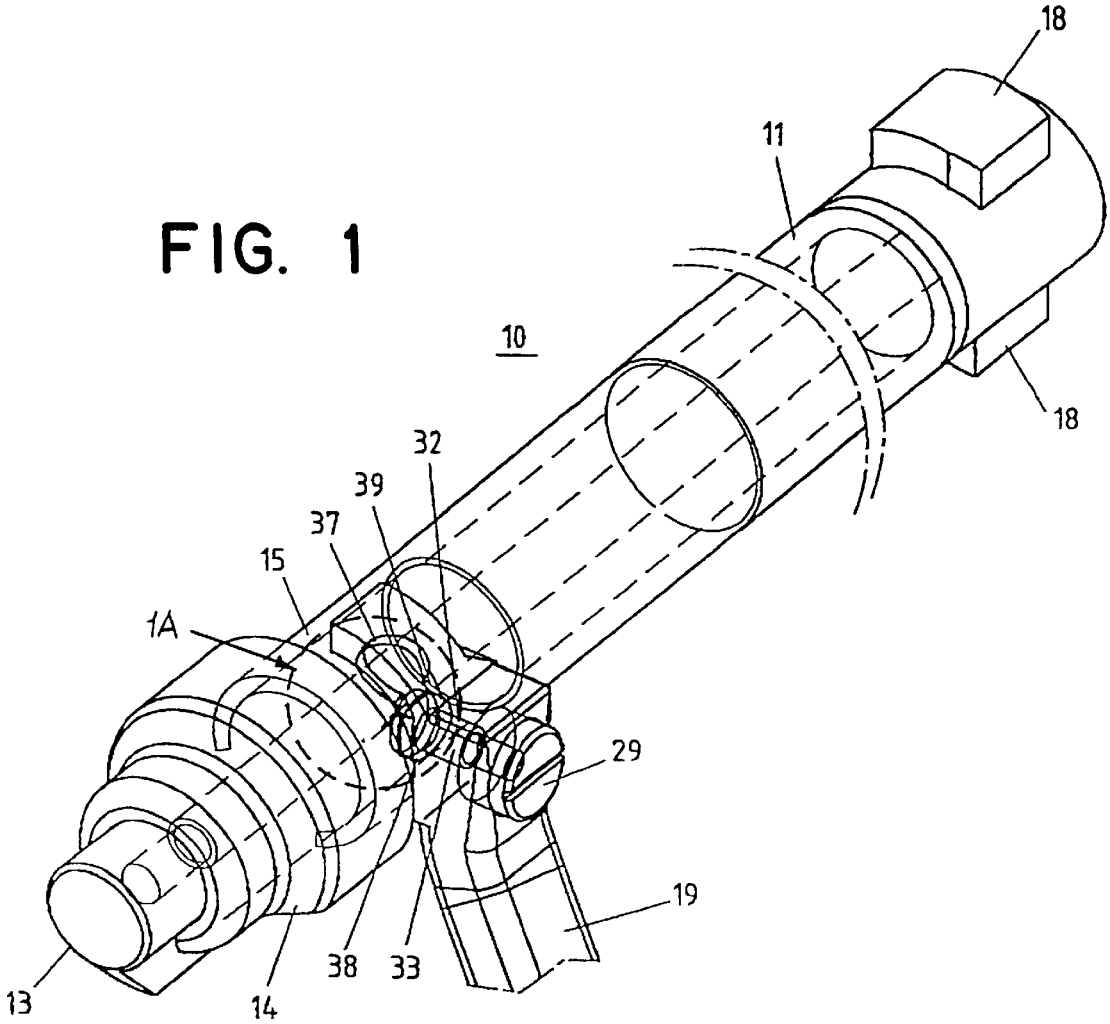
FIGS. 1 and 1A show a perspective representation of the securing means according to the invention for a breechblock for repeating weapons, and a cutout therefrom, respectively.
Figure 1A:
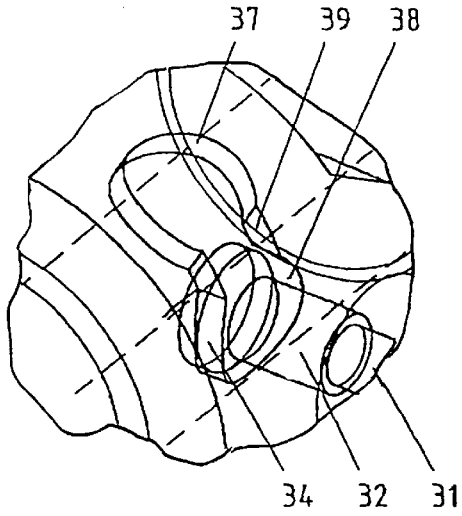

In order to give an overview, only the breechblock sleeve and the portions associated therewith that are constructed in accordance with the invention are shown in the Figures of the drawing, while the associated repeating weapon with the barrel, the bolt sleeve portions, the cartridge magazine and the trigger are left out.

Figure 2:
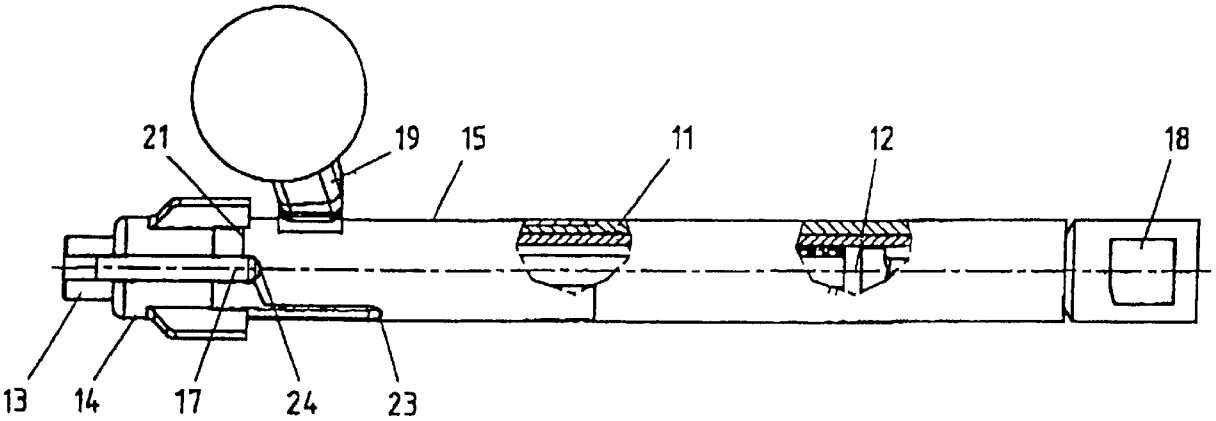
FIG. 2 shows a side view of the breechblock according to FIG. 1 in the securing position.
Figure 3:
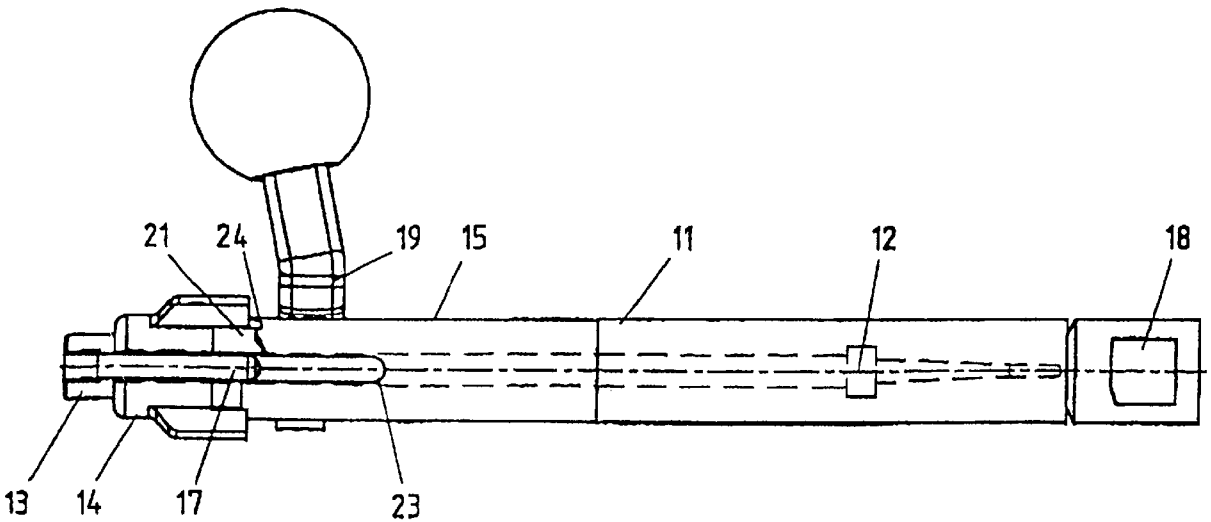
FIG. 3 shows a side view of the breechblock according to FIG. 1 in the safety-release position.

A breechblock, denoted overall with the reference numeral 10, comprises, as FIGS. 1 and 4 to 6 show in particular, a breechblock sleeve 11, through the centre of which travels a firing pin 12, with which a cocking piece 13 and a clasp nut 14 are associated. A bolt handle sleeve 15 is, as FIGS. 2 and 3 show in particular, pushed over a section of the breechblock sleeve 11 that has a smaller diameter than the bolt handle sleeve 15 and, at the rear end, is axially delimited by the clasp nut 14. The bolt handle sleeve 15 is pushed over the portion of the breechblock sleeve 11 that has the comparatively small diameter, and is axially delimited at the rear by the clasp nut 14. Two locking bosses 18 arranged opposite each other are also associated with the breechblock sleeve 11, while associated with the bolt handle sleeve 15 is a bolt handle 19. The clasp nut 14 forms the rear end of the bolt handle sleeve 15 which is pushed over the breechblock sleeve 11.

The components described above and their manner of operation are known per se and are not, therefore, represented and described in greater detail here.

Associated with the cocking piece 13 is an axially extending securing finger 17, which extends beyond the clasp nut 14 up to the end face 21 of the bolt handle sleeve 15 that faces the latter. Located in the end face 21 of the bolt handle sleeve 15 are a free milling 23 and a catch surface 24 for the securing finger 17, of which the free milling 23 is offset with respect to the catch surface 24 in the axial direction and by 60° at a distance which allows the striking movement of the firing pin 12 in the safety-release position of the breechblock; see also FIGS. 2 and 3.

Mounted in a spring-mounted manner in the foot of the bolt handle 19, in a recess 28, is an operating knob 29, for which purpose is used a spring 30 which is supported on the bottom surface of the recess 28. The operating knob 29 has a centrally arranged set screw 31, which is permanently connected to the shank portion 32 of a locking bolt 33 having a bolt head 34 and is guided in a bore of the bolt handle sleeve 15; see FIG. 1.

Associated with the bolt head 34 of the locking bolt 33, in a manner such that they are arranged at a distance from each other in the opposite region of the breechblock sleeve 11 and are offset by 90° with respect to each other, are locking grooves 37 and 38, the dimensions of which correspond with the bolt head 34 of the locking bolt 33. The two locking grooves 37 and 38 are connected to each other by way of a central recess 39 which corresponds with the shank portion 32 of the locking bolt 33; see FIG. 1.

In this connection, the locking groove 37 is associated with the securing position and the locking groove 38 is associated with the safety-release position of the breechblock 10. The arrangement of bolt handle sleeve 15 and cocking piece 13 is made in connection with the catch surface 24 and the free milling 23 in such a way that the catch surface 24 is associated with the locking groove 37 and the free milling 23 is associated with the locking groove 38.

Figure 4:
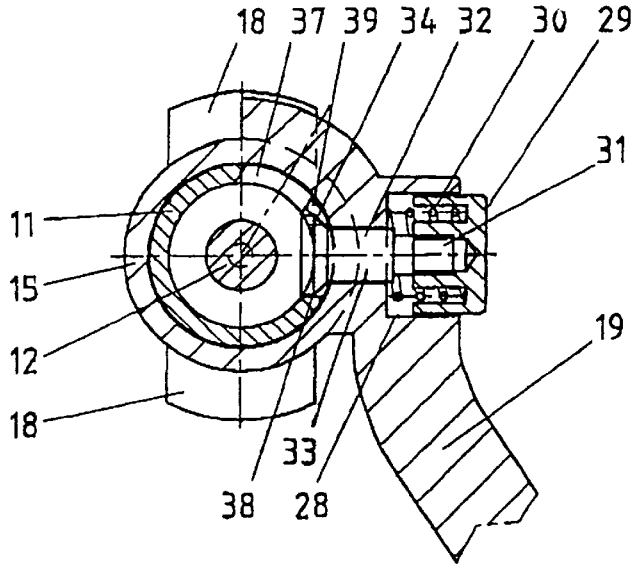
FIG. 4 shows a section through the breechblock in the securing position.
Figure 5:
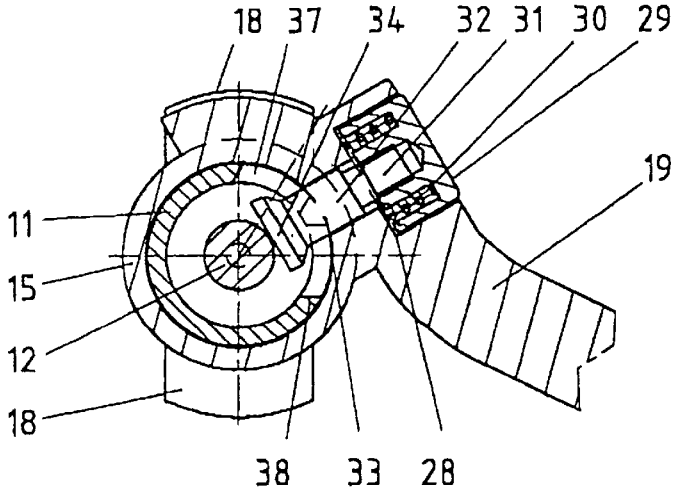
FIG. 5 shows a section in accordance with FIG. 4 during the movement of the bolt handle into the safety-release position.

When the operating knob 29 is pushed against the action of the spring 30, then by way of the set screw 31 the locking bolt 33 is pushed out of the locking groove 37 or 38 in which it was received until then, into the free space between the firing pin 12 and the breechblock sleeve 11—see FIG. 5—so that the bolt handle sleeve 15 can be operated in the desired way by way of the bolt handle 19. The shank portion 32 of the round locking bolt 33 thereby slides along the recess 39 into one or other of the end positions, in order to bring the bolt head 34 into spatial agreement with the locking groove 37 or 38 that was free until then. When the operating knob 29 is released, then by way of the spring 30 which then relaxes, the bolt head 34 of the locking bolt 33 is pulled into the associated locking groove 37 or 38 that is then opposite it. For the purpose of facilitating the bringing into engagement of the bolt head 34 of the locking bolt 33, the edges of the bolt head 34 that face the locking grooves 37 or 38 are gently bevelled, as FIGS. 4 to 6 show clearly.

Figure 6:
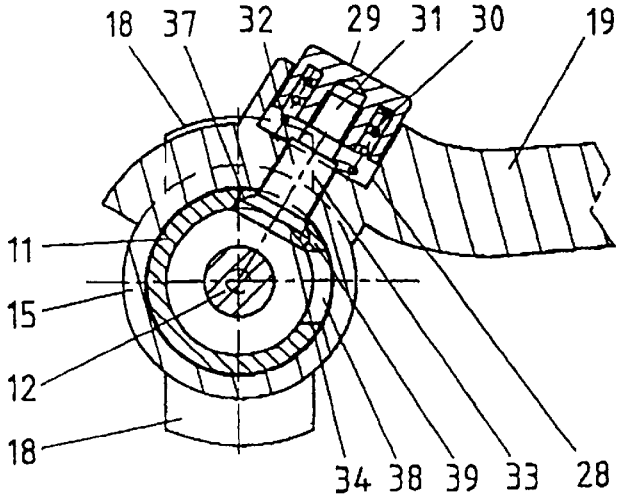
FIG. 6 shows a section corresponding to FIG. 4 in the safety-release position.

FIGS. 4 to 6 show the possible sequence of movements of the breechblock 10, with FIG. 4 showing the securing position, in which the locking bolt 33 is in engagement with the locking groove 38. In this position of the breechblock, the securing finger 17 rests against the catch surface 24 of the bolt handle sleeve 15. The firing pin 12 cannot, therefore, be released by way of the trigger (not shown). FIG. 5 shows the movement of the bolt handle 19 that is possible only when the operating knob 29 is pushed and the bolt handle sleeve 15 is thus moved downwards with respect to FIG. 5 into the safety-release position, which is shown in FIG. 6. There, the locking bolt 33 is shown with its bolt head 34 in engagement with the locking groove 37. In this position of the breechblock, the securing finger 17 is opposite the free milling 23 on the bolt handle sleeve 15, as a result of which the breechblock safety is released and, by way of the trigger (not shown), the firing pin 12 can be released, the striking movement of which is possible as a result of the free milling 23 on the bolt handle sleeve 15. Also in this position, the operating knob 29 takes up the position of rest determined by the spring 30. In the locked, cocked and safety-released position of the breechblock 10, the bolt handle 19 is horizontal and is locked by the locking bolt 33 engaging from below into the upper locking groove 37. As mentioned, the cocking piece 13, which is guided in the clasp nut 14 and screwed on to the firing pin 12, can strike forwards when the shot is fired.

The bolt handle 19 with the integrated operating knob 29 is therefore the single necessary operating element of the repeating weapon.

As also mentioned, the set screw 31, which is arranged concentrically with respect to the safety knob29 and screwed thereto, turns into the shank portion 32 of the locking bolt 33 and the safety knob 29 is mounted in a blind bore 28 arranged on the bolt handle 19 in a manner such that it is movable against the action of the spring 30.

What is claimed is:

1. A safety mechanism for a breechblock for a repeating weapon comprising a breechblock sleeve;

a firing pin surrounded by the breechblock sleeve;

a bolt handle sleeve supported by the breechblock sleeve;

the breechblock sleeve is capable of being locked in a cocked state of the breechblock by means of locking bosses;

the locking bosses engage in corresponding recesses in the sleeve, and including securing means for securing and releasing the firing pin in cocked position;

the securing means comprise a locking bolt and a securing finger;

the locking bolt, by way of a bolt handle and an operating knob, which is spring-mounted on the bolt handle, is capable of being brought into engagement with one of two locking grooves in the breechblock sleeve;

the two locking grooves are associated with the securing position and the safety-release position of the breechblock;

the securing finger is formed as part of a cocking piece of the breechblock, and in the safety-release position of the breechblock there is a corresponding free milling on the bolt handle sleeve that allows the movement of the firing pin;

the locking bolt, which can be brought into engagement with the locking grooves, has a bolt head which corresponds with the locking grooves of the breechblock sleeve;

the locking grooves, for the purpose of receiving a shank portion of the locking bolt, are connected to each other by way of a central recess, with the shank portion of the locking bolt being operatively connected to a set screw of the operating knob, which is held on the bolt handle such that it springs into the securing position; and the locking grooves are arranged in the breechblock sleeve in a manner that they are offset by 60° with respect to each other and form with the central recess an opening in the lateral surface of the breechblock sleeve.

2. The safety mechanism according to claim wherein the bolt handle sleeve includes an end face and a catch surface both facing the securing finger, arranges such that when in securing position of the breechblock, the catch surface prevents a movement of the firing pin, while when in safety-release position, the free milling allows a movement of the firing pin.

3. The safety mechanism according to claim 1, further comprising a safety knob and wherein the set screw is arranged concentrically with respect to the safety knob and is screwed thereto, the set screw is permanently connected to the shank portion of the locking bolt; and the safety know is mounted in a blind bore arranged on the bolt handle such that it is movable against the action of a spring.

* * * * *